US011086246B2

(12) United States Patent
Williams et al.

(10) Patent No.: US 11,086,246 B2
(45) Date of Patent: Aug. 10, 2021

(54) METHOD AND APPARATUS FOR VARIABLE GLOSS REDUCTION

(71) Applicant: ELECTRONICS FOR IMAGING, INC., Fremont, CA (US)

(72) Inventors: Leon Williams, Foster City, CA (US); Thor Olson, Minneapolis, MN (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 16/432,800

(22) Filed: Jun. 5, 2019

(65) Prior Publication Data

US 2019/0286002 A1 Sep. 19, 2019

Related U.S. Application Data

(60) Division of application No. 16/173,339, filed on Oct. 29, 2018, which is a division of application No. (Continued)

(51) Int. Cl.
*G03G 13/20* (2006.01)
*G03G 15/20* (2006.01)

(52) U.S. Cl.
CPC ..... *G03G 13/20* (2013.01); *G03G 15/2025* (2013.01); *G03G 15/2039* (2013.01); (Continued)

(58) Field of Classification Search
CPC ..... G03G 13/20; G03G 15/2025; G03G 15/2039; G03G 15/2053; G03G 15/2064; G03G 2215/00805; G03G 2215/0081
See application file for complete search history.

(56) References Cited

U.S. PATENT DOCUMENTS 4,083,322 A 4/1978 Beckman
4,258,095 A 3/1981 Larson et al.
(Continued)

FOREIGN PATENT DOCUMENTS

CN 1213612 A 4/1999
CN 101687217 A 3/2010
(Continued)

OTHER PUBLICATIONS

Schmitt Industries Inc. , "Technology Overview", Tech Overview, Effects of Surface Roughness; retrieved online from url: http:www.schmitt-ind.com/support-technical-papers-scatter.shtml#intro, Jul. 25, 2002, 5 pages.

*Primary Examiner* — Alexander M Weddle
(74) *Attorney, Agent, or Firm* — Perkins Coie LLP

(57) ABSTRACT

Various variable gloss reduction techniques are disclosed. In one embodiment, a gloss reduction technique is disclosed using a textured roller and a wiper impregnated with fuser oil to create a differential gloss pattern that reduces the gloss of an image printed on a substrate. In one embodiment, a gloss reduction technique is disclosed using a combination of heat and pressure to create a differential gloss pattern that reduces the gloss in specific regions of an image printed on a substrate. In one embodiment, a gloss reduction technique is disclosed using a differential gloss pattern to generate a security mark on a printed image to prevent against copying or fraudulent misrepresentation of the image.

5 Claims, 11 Drawing Sheets

Related U.S. Application Data

14/054,711, filed on Oct. 15, 2013, now Pat. No. 10,114,307, which is a continuation-in-part of application No. 13/629,298, filed on Sep. 27, 2012, now Pat. No. 9,952,539.

(52) U.S. Cl.
CPC ..... *G03G 15/2053* (2013.01); *G03G 15/2064* (2013.01); *G03G 2215/0081* (2013.01); *G03G 2215/00805* (2013.01)

(56) References Cited

U.S. PATENT DOCUMENTS

| | | | |
|---|---|---|---|
| 4,662,992 | A | 5/1987 | Mirsberger |
| 5,118,589 | A | 6/1992 | Aslam et al. |
| 5,234,784 | A | 8/1993 | Aslam et al. |
| 5,392,702 | A | 2/1995 | Suzuki et al. |
| 5,448,339 | A | 9/1995 | Nishiguchi et al. |
| 5,478,423 | A | 12/1995 | Williamson et al. |
| 5,493,378 | A | 2/1996 | Jamzadeh et al. |
| 5,636,012 | A | 6/1997 | Uneme et al. |
| 5,681,494 | A | 10/1997 | Katsuura et al. |
| 5,890,032 | A | 3/1999 | Aslam et al. |
| 5,987,293 | A | 11/1999 | Diels et al. |
| 6,164,849 | A | 12/2000 | Koyama et al. |
| 6,668,152 | B1 | 12/2003 | Jacob |
| 7,305,198 | B2 | 12/2007 | Julien |
| 8,195,056 | B2 | 6/2012 | Misawa |
| 8,623,140 | B2 | 1/2014 | Yapel et al. |
| 8,730,285 | B2 | 5/2014 | Aoki et al. |
| 2002/0023708 | A1 | 2/2002 | Tronchetti |
| 2002/0076229 | A1 | 6/2002 | Allmendinger |
| 2003/0099007 | A1 | 5/2003 | Towner et al. |
| 2003/0223792 | A1 | 12/2003 | Chen et al. |
| 2004/0070658 | A1 | 4/2004 | Janosky et al. |
| 2004/0105700 | A1* | 6/2004 | Herrmann ..... G03G 15/6582 399/159 |
| 2004/0190925 | A1 | 9/2004 | Baruch et al. |
| 2005/0197239 | A1 | 9/2005 | Bomba et al. |
| 2006/0062586 | A1 | 3/2006 | Sone et al. |
| 2006/0110193 | A1 | 5/2006 | Emmert et al. |
| 2006/0115306 | A1 | 6/2006 | Lofthus et al. |
| 2007/0071474 | A1 | 3/2007 | Watanabe et al. |
| 2007/0086803 | A1 | 4/2007 | Kimura et al. |
| 2007/0140718 | A1 | 6/2007 | Mulder et al. |
| 2007/0206980 | A1 | 9/2007 | Frohlich |
| 2007/0217819 | A1 | 9/2007 | Sone et al. |
| 2007/0280758 | A1* | 12/2007 | Ciaschi ..... G03G 9/08782 399/336 |
| 2008/0000744 | A1 | 1/2008 | Yasumoto |
| 2008/0193860 | A1 | 8/2008 | Hains |
| 2009/0029054 | A1 | 1/2009 | Yapel et al. |
| 2009/0029154 | A1 | 1/2009 | Hala et al. |
| 2009/0238594 | A1 | 9/2009 | Barton |
| 2009/0238616 | A1 | 9/2009 | Ciaschi |
| 2010/0021198 | A1 | 1/2010 | Thayer et al. |
| 2010/0322684 | A1 | 12/2010 | Kikuchi et al. |
| 2011/0194867 | A1 | 8/2011 | Mills et al. |
| 2012/0155939 | A1 | 6/2012 | Fukatsu et al. |
| 2013/0129932 | A1 | 5/2013 | Pickering et al. |
| 2013/0236220 | A1 | 9/2013 | Mito et al. |
| 2014/0199090 | A1 | 7/2014 | Kikushima |

FOREIGN PATENT DOCUMENTS

| | | | |
|---|---|---|---|
| CN | 102236313 | A | 11/2011 |
| EP | 2713223 | A2 | 4/2014 |
| WO | 2013032772 | A1 | 3/2013 |
| WO | 2015057848 | A1 | 4/2015 |

* cited by examiner

METHOD AND APPARATUS FOR VARIABLE GLOSS REDUCTION

CROSS REFERENCE TO RELATED APPLICATIONS

This application is a divisional of U.S. patent application Ser. No. 16/173,339, filed on Oct. 29, 2018, which is a divisional of U.S. patent application Ser. No. 14/054,711, filed on Oct. 15, 2013, which issued on Oct. 30, 2018 as U.S. Pat. No. 10,114,307, which is a continuation-in-part of U.S. patent application Ser. No. 13/629,298, filed on Sep. 27, 2012, which issued on Apr. 24, 2018 as U.S. Pat. No. 9,952,539, each of which are incorporated herein in their entirety by this reference thereto.

BACKGROUND OF THE INVENTION

Technical Field

The invention relates to printing. More particularly, the invention relates to a method and apparatus for variable gloss reduction.

Description of the Background Art

Currently, many of the toner based print engines suffer from a limitation in that they produce glossy images as a result of the inherent toner properties and fusing process. As the toner pile height increases, the toner must be melted into an almost liquid state for sufficient adherence to paper. The liquid state of the toner results in a very smooth surface for high coverage regions of the page. This smooth surface, in turn, has a high specular reflection that is objectionable in some applications and to some users. Competitive presses, such as those that use offset lithography and those that use, for example, HP Indigo liquid toner, yield a low gloss and therefore have a market advantage.

Some manufactures, including Xerox, attempt to reduce the gloss of the melted toner by changing the toner formulation to solidify in a less smooth form. This suffers from at least the following limitations:

1) There is marginal gloss reduction;
2) The press can only produce two levels of gloss corresponding to which toner formulation is installed;
3) It is expensive and time consuming to switch between toners because the machine must be set up differently and all toner of one type extracted before the other formulation is installed; and
4) The two different toner formulations must be stocked in the supply chain.

SUMMARY OF THE INVENTION

Embodiments of the invention provide a method and apparatus for reducing the smoothness of a toner layer and thus reduce the gloss of a resulting print. The invention overcomes the above-mentioned limitations of the state of the art by enabling a single toner formulation, the original high gloss version, to print all images. A new finishing option is required which, through application of a combination of heat and pressure with a textured roller, reduces the specular gloss of the toner surface by imprinting a high frequency texture onto the smooth toner layer. By adjusting the temperature/pressure of the textured roller, the effective gloss of the press can be adjusted through software as desired.

DETAILED DESCRIPTION OF THE INVENTION

Embodiments of the invention provide a method and apparatus for reducing the smoothness of a toner layer and thus reduce the gloss of a resulting print. The invention overcomes the above-mentioned limitations of the state of the art by enabling a single toner, the original high gloss version, to print all images. A new finishing option is required which, through application of a combination of heat and pressure with a textured roller, reduces the specular gloss of the toner surface by imprinting a high frequency texture onto the smooth toner layer. By adjusting the temperature/pressure of the textured roller, the effective gloss of the press can be adjusted through software as desired.

Figure 1:
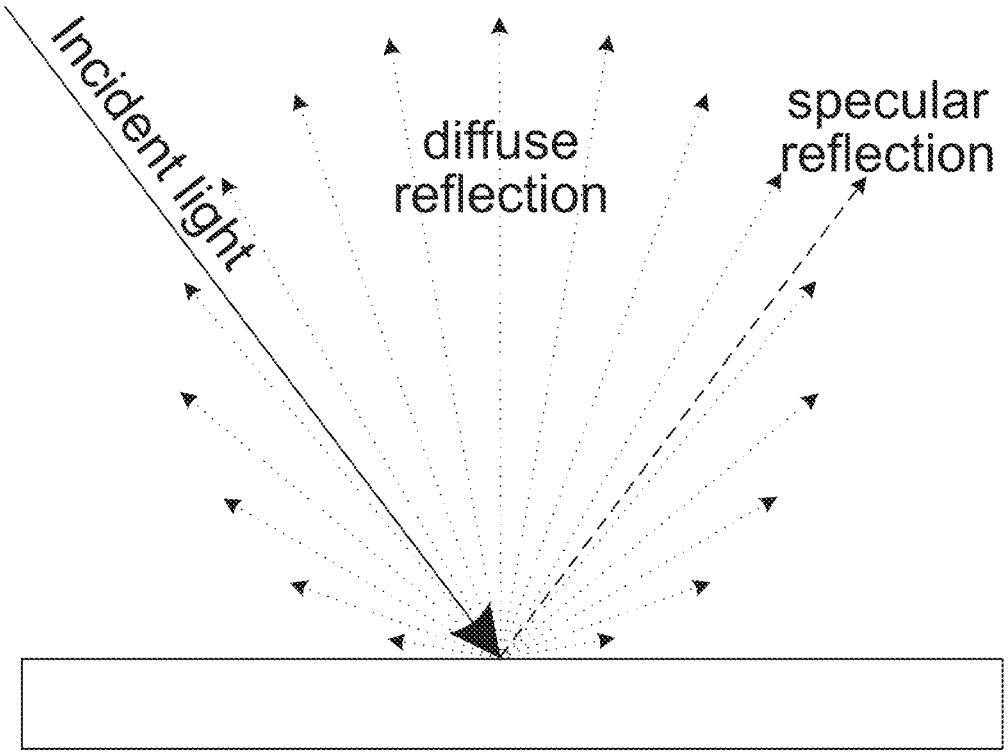
Figure 1 (Prior Art)
FIG. 1 is a schematic representation of a substrate surface showing incident light, diffuse reflection, and specular reflection.

Gloss is an optical property describing the ability of a surface to reflect light into the specular direction. The smoothness of the surface determines the amount of specular reflection. Increasing the roughness of a surface increase diffuse reflection, and thus reduces the glossiness of the surface. See FIG. 1.

Figure 2:
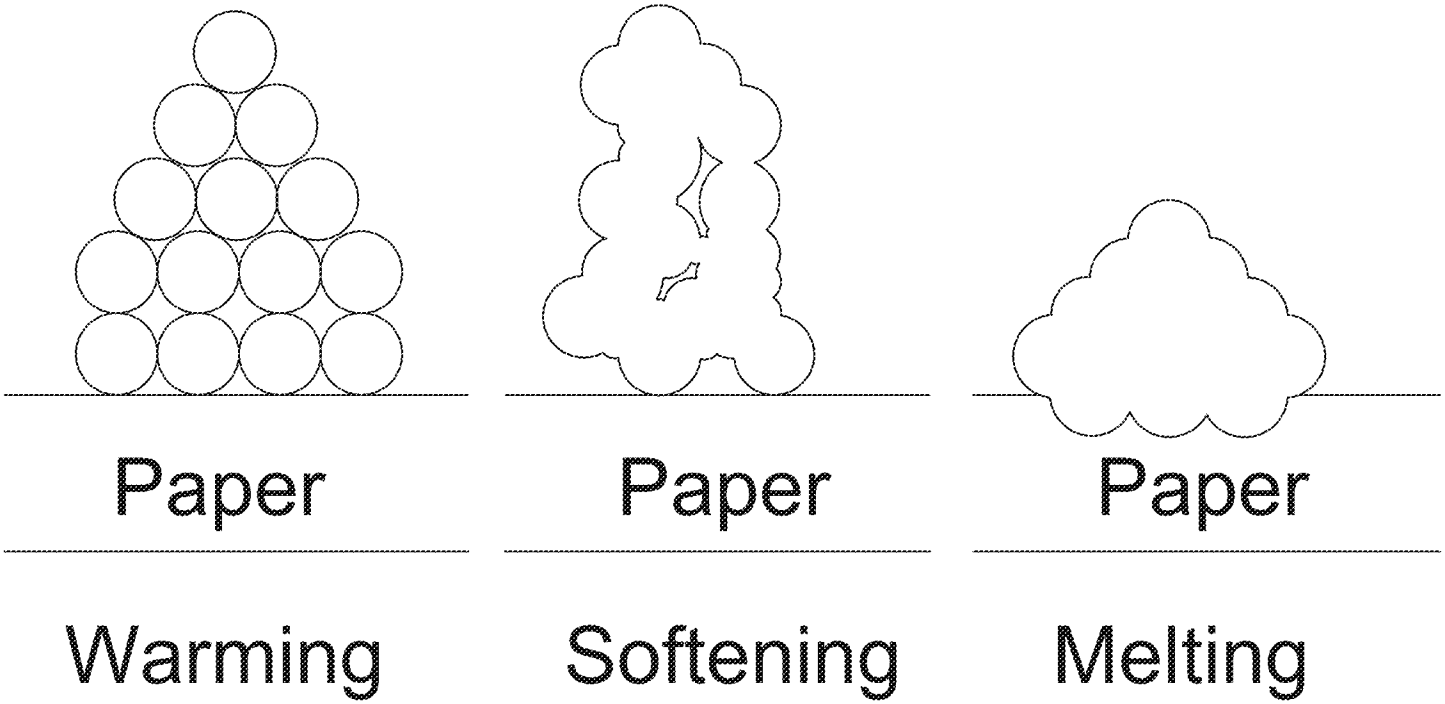
Figure 2 (Prior Art)
FIG. 2 is a schematic representation of three phases of thermal changes in the toner during the fusing process.

When an image is applied to a substrate, thermal changes in the toner during the fusing process can be divided into three stages (see FIG. 2):

Warming—Increase in temperature of toner particles and paper;

Softening—Melting of the toner starts from the surface of particles and toner particles; and Melting—Partly melted toner adheres to the paper.

Figure 3:
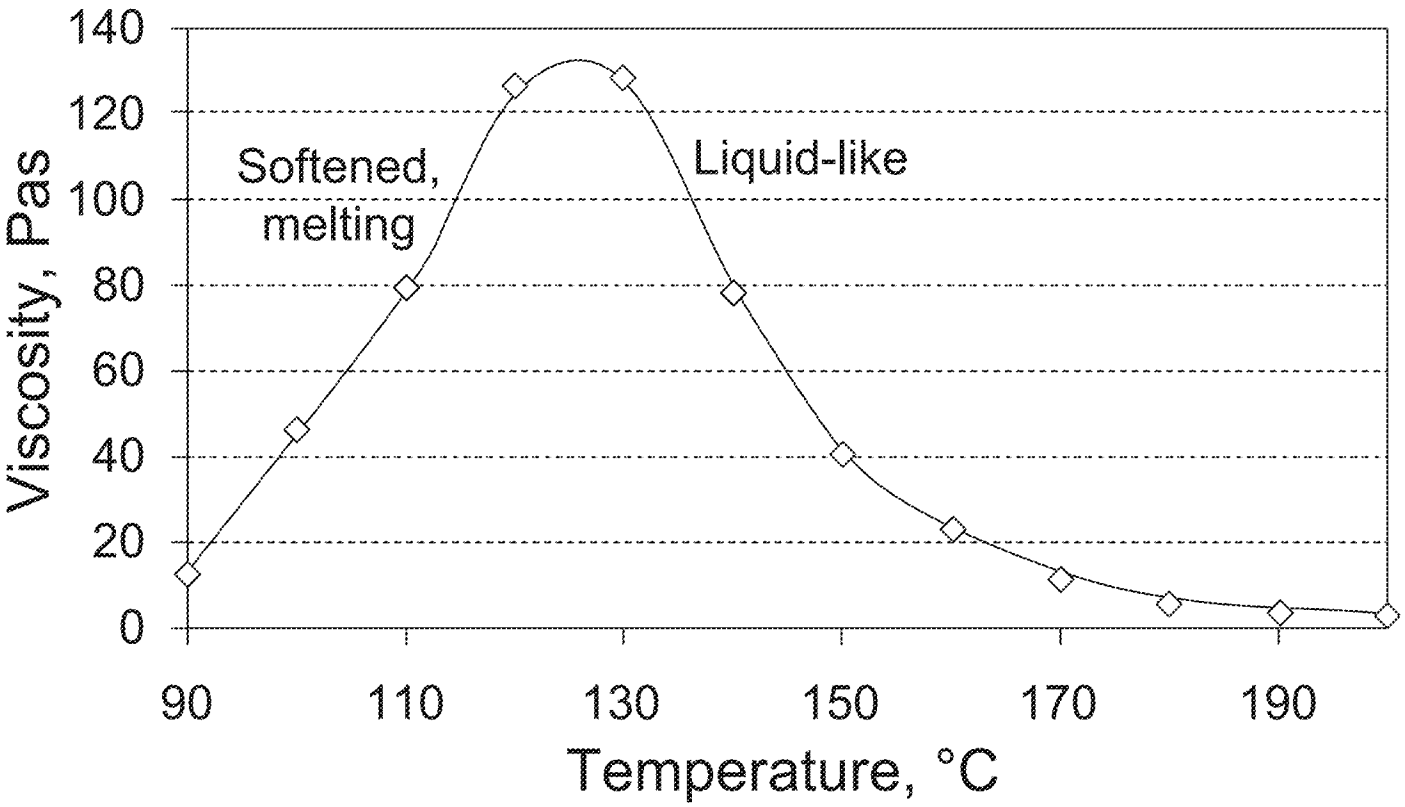
Figure 3 (Prior Art)
FIG. 3 is a graph that shows viscosity vs. temperature for a toner.

FIG. 3 is a graph that shows viscosity vs. temperature for a typical toner used by one of ordinary skill in the art. As can be deduced from the graph, viscosity is a function of temperature. Further, it is generally known by those of ordinary skill in the art that adhesion of the toner to a particular surface of a substrate (e.g., paper, etc.) depends on its viscosity and melting temperature. Adhesion of the toner is complete when it is fully melted. As such, by applying a certain amount of heat to the toner, the temperature of the toner can be adjusted to work with the variable gloss reduction technique disclosed herein.

Figure 4:
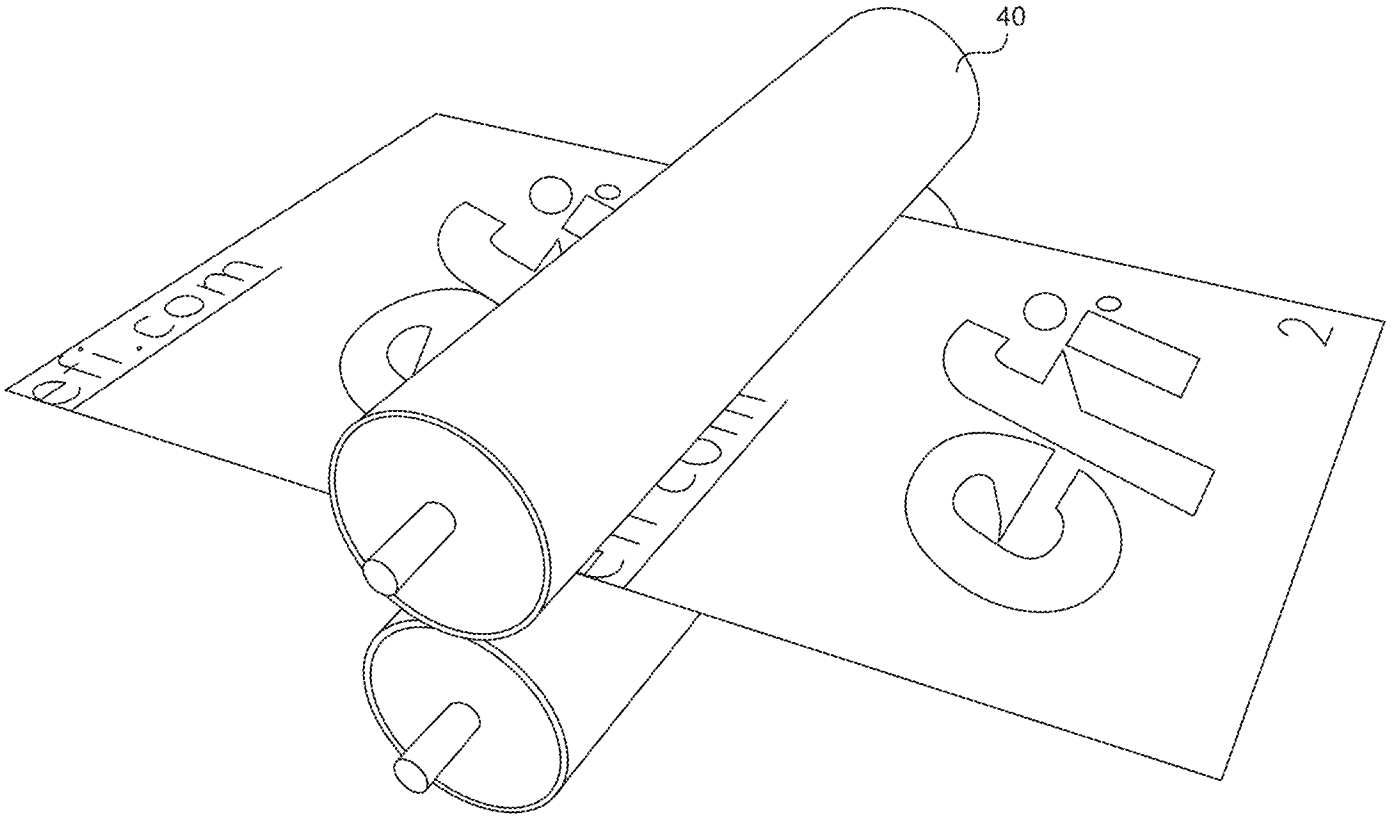
FIG. 4 is a perspective view of a textured roller arrangement according to an embodiment.

An embodiment of the invention provides a method and apparatus for de-glossing toner that is applied to a substrate surface as follows:

FIG. 4 is a perspective view of a textured roller arrangement according to the invention. To reduce the gloss of a print, the roughness of the toner surface is increased. Increasing the roughness of toner is accomplished with a heated, textured roller 40 and pressure.

The roller can be either solid or a hollow cylinder formed from metal or other rigid surface. The material must be rigid enough to accept and maintain the texture as it presses against the many hundreds of thousands of pages to be de-glossed. The texturing is accomplished by starting with a smooth roller and removing material in the desired pattern. This pattern can be a regularly repeating pattern, such as a screen, or a random pattern of some stochastic nature. One method to apply the texture is applying a photo resist, exposing the resist to light, and chemically etching the material away. Another method is to use a high-powered laser to etch the roller's surface. The amount of gloss reduction can be controlled by adjusting the textured roller's temperature. The roller can be heated to the desired temperature by several means. If an electric resistance coil is used to generate heat, the coil can be positioned inside the roller in direct contact with the surface or outside the roller and blowing air to increase the roller's temperature. Another method is induction heating, where the use of high-frequency switching magnetic fields induces currents in a metal roller to increase its temperature.

A temperature sensor can be employed to measure the roller's surface temperature. A control loop is then used to set the roller to the desired, programmable temperature that results in the desired gloss reduction. This controls how deeply the textured surface can penetrate the toner's surface layer based on the softening and melting point of the toner (see FIG. 5).

In an embodiment, the visibility of the texture is hidden by making the texture at a high frequency, e.g. 150+ line per inch (LPI). Laser etching a steel roller created this texture pattern. The depth of the texturing is limited as the frequency of the texture is increased. At 150 LPI, the depth of the texture is approximately 60 um. This is sufficient to penetrate the 3 to 8 um toner pile height evenly. At 220 LPI, the texture is limited to −30 um, and at 300 LPI it is further reduced to −18 um. The texture frequency should be high enough not to be visible, but low enough to enable sufficient depth to penetrate the toner layer smoothly.

Figure 5:
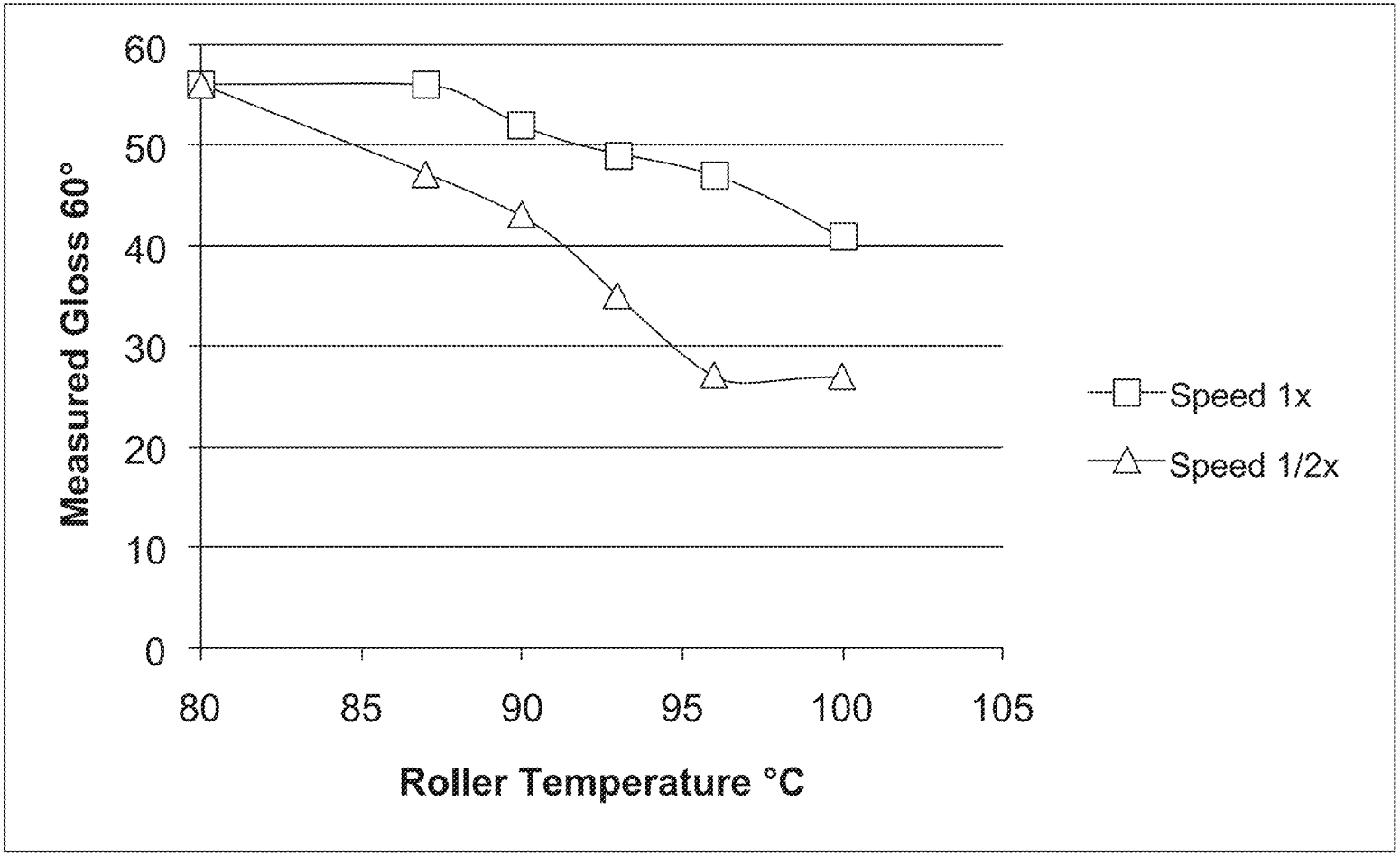
FIG. 5 is a graph that shows testing results with a 150 LPI roller according to an embodiment.

Initial testing results with a 150 LPI roller are shown in FIG. 5, which is a diagram of actual test results and that shows the gloss, as measured by a gloss checker, vs. the roller temperature. FIG. 5 confirms that, as the roller's nominal temperature is increased, and other variables such as rotational speed and pressure remain the same, the amount of gloss on a page is reduced. The pages before gloss reduction measure at about 55 gloss units (gl). When the roller is at 80 degrees or below, the page after deglossing process remains (for all practical purposes) unchanged. As the roller's temperature is increased, subsequent identical incoming pages of 55 gl are measured after deglossing and are measured with less gloss. The full speed line is running at about 80 pages per minute (PPM). The half speed line is about 40 PPM. The reason the gloss is further reduced from full speed to half speed is that the increased time of contact at half speed enables more energy to be applied to the toner, and thus enables additional softening.

Figure 6:
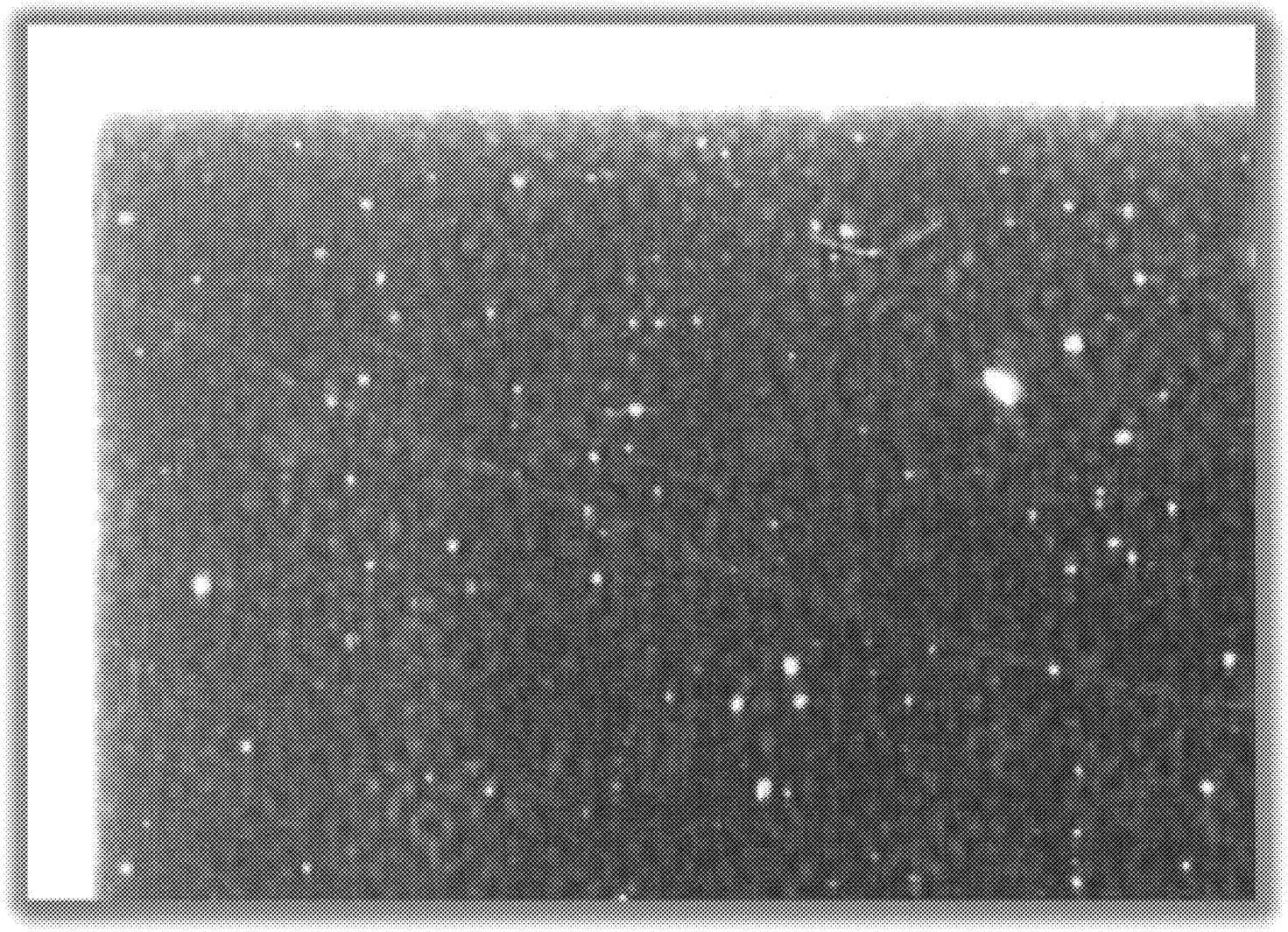
FIG. 6 is a photograph showing a magnified region of a page in which a halftone of the CMYK toner layers is visible.
Figure 7:
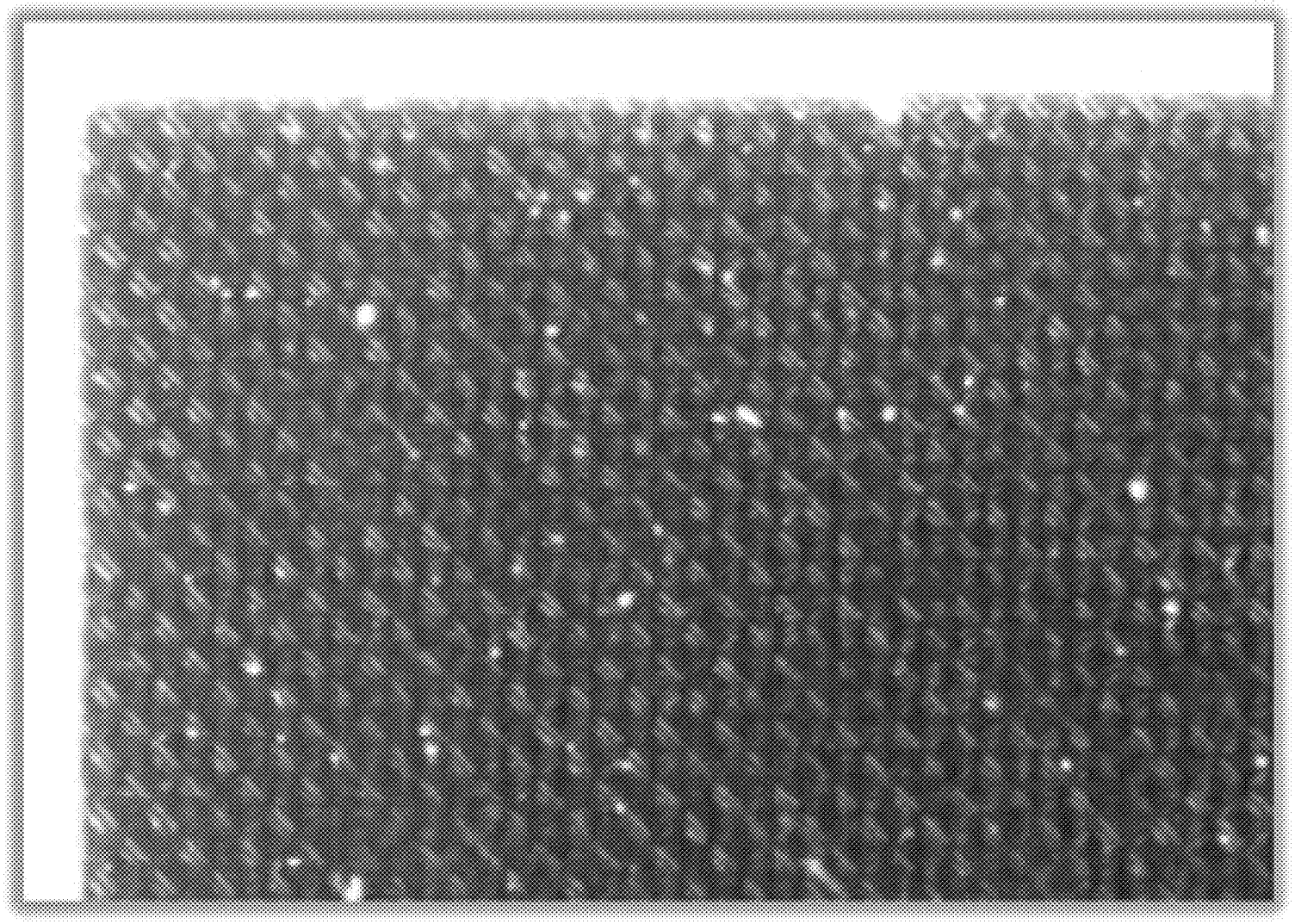
FIG. 7 is a photograph showing the same region of the page of FIG. 6 after de-glossing.

FIG. 6 is a photograph showing a magnified region of a print in which a halftone of the CMYK toner layers is visible. FIG. 7 is a photograph showing the same region of the page shown in FIG. 6 after de-glossing. Notice that the surface now has a diamond pattern visible and that the light reflects differently because the surface of the toner has been changed from flat to textured.

An embodiment of the invention can be used with the Prowler (Xerox Chamonix). Additionally, it can be used with iGen and other toner engines from Ricoh, KM, Canon, and others. This roller can be used inline or offline. For the case of inline, a deglossing finisher unit includes the mechanical components necessary to transport paper from the input to the heated/textured roller and then eject the page at the output. Most digital presses have a standard physical and electrical design to enable multiple finishing options to be configured as needed. For the offline case, stacks of pages previously printed by a press are placed in a sheet feeder. The sheet feeder pulls each page, one at a time, from the top of stack and feeds it to the deglossing finisher, which can be the same design as the inline degloss finisher. At this time, it is anticipated that the roller pressure is not adjusted during a press run other than to cam in or cam out the rollers to enable/disable deglossing on a page by page basis. The pressure is adjusted by springs and/or gas pressure solenoids. The heat is modulated, as described above, using a control loop with resistive or induction heating.

Figure 8:
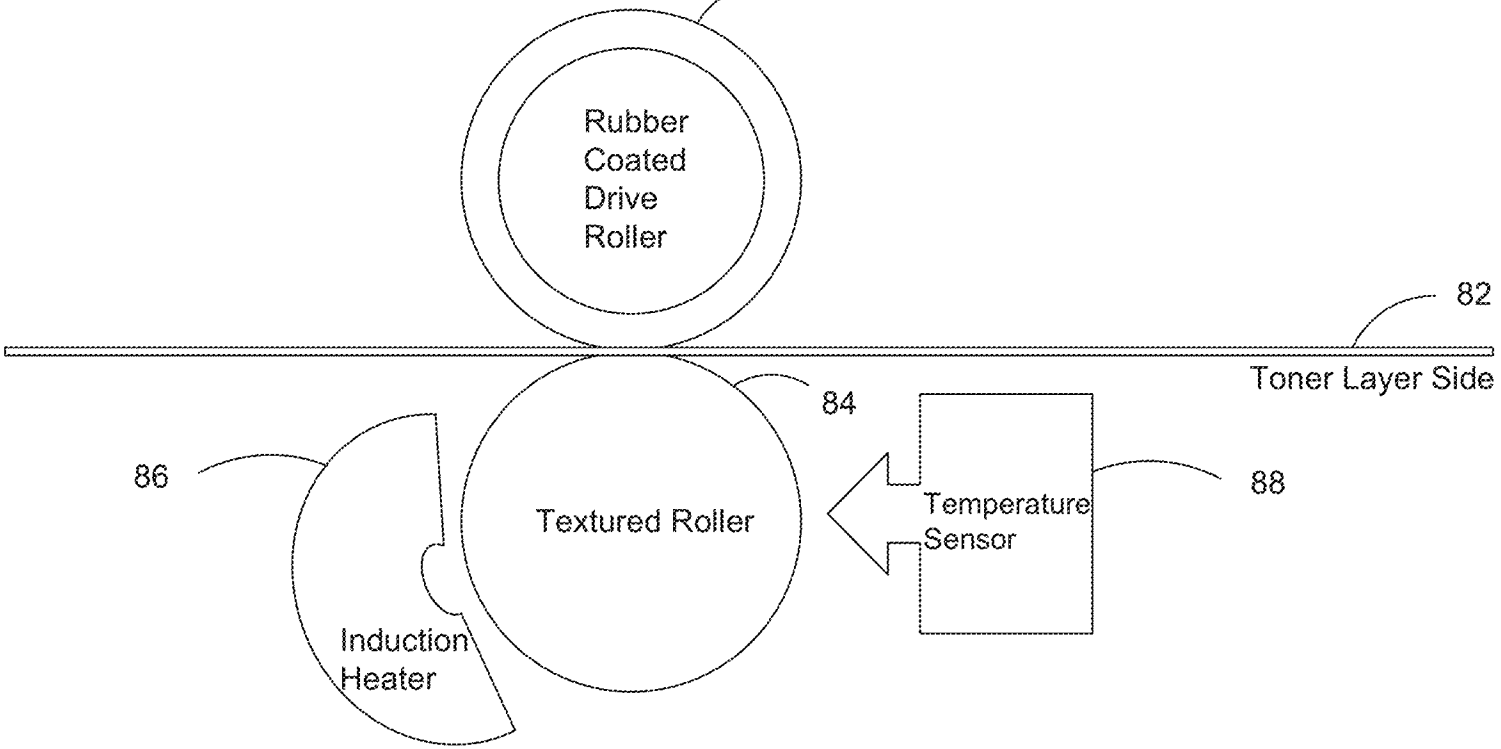
FIG. 8 is a perspective side view of a textured roller arrangement with one or more sensors according to an embodiment.

Another embodiment of the invention is provided in FIG. 8, which is a perspective side view of a gloss reduction system with one or more sensors 88. FIG. 8 includes a substrate 82, such as a piece of paper, that has a toner layer on one side; an image may be formed (i.e., printed) via the toner layer on the substrate. The substrate 82, with the toner, is pressed between a rubber coated driver roller 80 and a textured roller 84, which imprints a high frequency pattern onto the toner layer. As discussed above, the high frequency imprinting de-glosses the image formed on the substrate (i.e., brings about an effective gloss on the image). The imprinting is executed by an application of a selected combination of heat and pressure by the textured roller 84. According to the embodiment, the temperature of the roller may be controlled using one or more sensors 88 coupled with one or more induction heaters 86.

Using the one or more sensors 88 (i.e., "multiple sensors") and one or more induction heaters allows forming of a closed loop control system around the texture roller 84. Together, the sensor(s) 88 and the multiple segmented induction coil heater(s) 86 arranged across the face of the textured roller 84 provide and maintain a more uniform temperature for the roller.

The sensors may be, for example, infrared, non-contact temperature sensors. The sensor(s) may be used to measure a current temperature of the textured roller 84 and to adjust, i.e., increase or decrease, the power to the induction heater(s) 86. Such power adjustment helps maintain the roller's temperature at a desired set point. Ultimately, adjustment of the temperature allows for adjustment of the effective gloss of the image.

The control system that may be utilized with the one or more sensors may be, for example, a PID controller (i.e., a proportional, integral, derivative controller). As well-known by those of ordinary skill in the art, a PID controller is a controller that takes into mathematical consideration a proportional gain, an integral gain, and a derivative gain of the response parameters of a closed-loop system. PID controllers are generally used in many industrial processes due to its simplicity and optimal performance in many applications. Such a PID controller may be utilized, for example, in the variable gloss reduction system disclosed herein to control the one or more sensors. The PID controller may also be used to control other aspects of the variable gloss reduction system.

Figure 9:
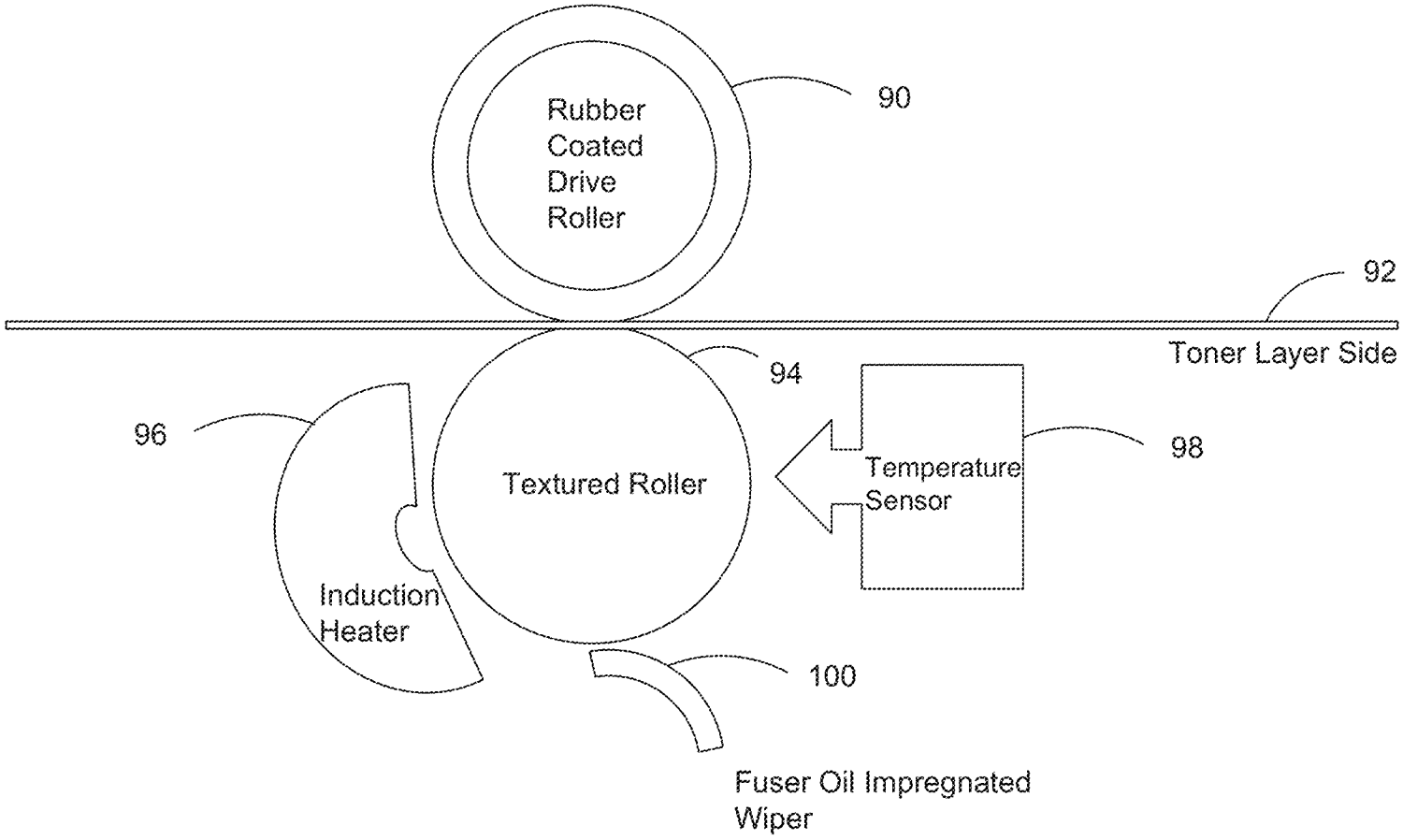
FIG. 9 is a perspective side view of a textured roller arrangement with a wiper impregnated with fusion oil according to an embodiment.

FIG. 9 is a perspective side view of a gloss reduction system with a fuser oil impregnated wiper according to an embodiment of the invention. FIG. 9 includes a substrate 92, such as a piece of paper, that has a toner layer on one side; an image may be formed (i.e., printed) via the toner layer on the substrate. The substrate 92, with the toner layer, is pressed between a rubber coated driver roller 90 and a textured roller 94, which imprints a high frequency pattern onto the toner layer to reduce the gloss of the image (i.e., generate an effective gloss).

According to the embodiment, a fuser oil impregnated wiper 100 is added to the gloss reduction system. In some embodiments, the wiper 100 can be utilized to clean the textured roller. In other embodiments, the wiper can be utilized to apply a coating of fuser oil onto the toner layer side of the substrate 92. In yet other embodiments, the wiper may be utilized to both clean the textured roller and to apply the coating of fuser oil.

The fuser oil can be any substance that provides a barrier against adhesion. Such substance may be, for example, the polyorgano siloxanes described in U.S. Pat. No. 4,029,827. (See, http://www.google.com/patents/US4029827.) The coating of fuser oil provides a barrier that is formed between the toner layer of the substrate 92 and the textured roller 94. The barrier prevents adhesion of the toner to the roller 94 when the roller is applied onto the toner layer.

The wiper 100 may be composed of any heat resistant felt fabric. The fabric is of the type that can retain the fuser oil and apply the oil continuously to the textured roller 94 on each revolution. The fuser oil can be replenished in the heat resistant felt fabric through either an automatic process or a manual process of injecting oil from a reservoir into the wiper 100.

Figure 10:
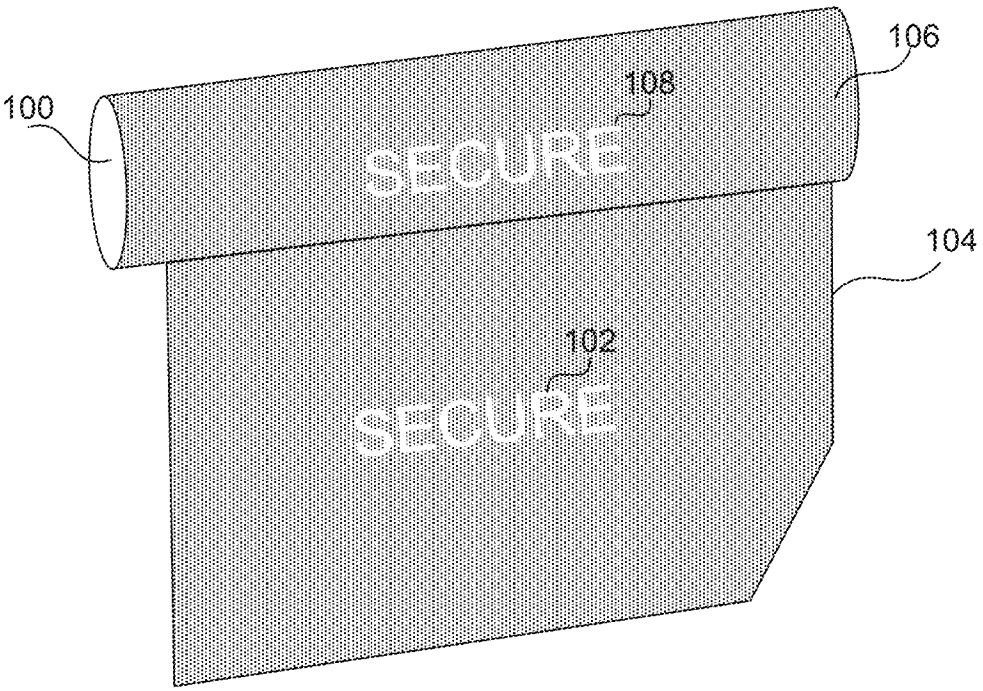
FIG. 10 is a diagram showing a textured roller imprinting a security code onto a document according to an embodiment.

FIG. 10 is a diagram showing a textured roller 100, coupled with another roller (e.g., the rubber coated roller 80 of FIG. 8), to imprint a security code 102 onto a substrate according to an embodiment. As will be discussed in further details herein, the variable gloss reduction technique using the textured roller 100 can be utilized to provide a security protection technique that deters (and helps detect) copying of a printed image on a substrate, such as a piece of paper. Before further discussion of the security protection technique, it is useful first to consider an example of a substrate in which such a technique can be implemented advantageously. One example of such a substrate is a piece of paper having printed thereon an image, i.e., a printed document. As used herein, a "printed document" is a piece of paper with an image printed thereon by application of a toner layer onto the paper. The image may include, for example, a pictorial illustration and/or lines of text. It is noted that one of ordinary skill in the art will appreciate that the technique discussed herein could also be applied to any other substrates with an image printed thereon besides a printed document.

In general, a printed document is often subject to copying and/or fraudulent misrepresentation of the original. Many approaches have been attempted to address such problems by embedding a security feature into the document; an ordinary observer would be able to detect a fraudulent copy when the security feature is missing. One typical approach utilizes two or more halftones to generate different gloss levels, i.e., different halftone regions, on the document to create a security gloss pattern. Generally, a first halftone is applied for some portion of an image that is printed on the document, and a second halftone is applied for the remaining portion of the image. As a result of the halftones, a difference in gloss levels can be observed from the image. The entire document, however, maintains a consistent density across the surface of the image. The gloss level difference creates a visual "glossmark" that is observable to serve as a security code signifying the document is an original. Mere visual differences in gloss levels, however, are still subject to manipulations, leaving an observer still unable to detect copying.

In contrast to traditional approaches, an embodiment of the present invention utilizes textured regions to provide an enhanced security feature for a printed document. Using the security protection technique disclosed herein allows an original document to exhibit both a gloss level difference and a density difference between different regions of the document. In particular, the technique utilizes the textured roller 100 in conjunction with a temperature/pressure adjustment system, as discussed above, to create regions of variable gloss reductions on a smooth toner layer (i.e., printed image) of the document. The textured roller 100 can be configured to imprint a frequency texture at specific spots, or locations, on the image, according to user-specified configurations, to form certain deglossed regions on the image of the substrate. As a result, a differential gloss pattern is formed and serves as the security code that can be visually seen by observation of the texture and gloss differences present on the image.

Referring to FIG. 10, the document 104 exhibits the security code "SECURE" 102 generated by the textured roller 100. The security code 102 is first generated on a surface of the textured roller 100. In particular, the textured roller 100 is etched with a security pattern to imprint the security code 102 onto the document 104. The etching may be done, for example, by laser etching onto the surface of the roller. As used herein, the term "security pattern" refers to a pattern formed by a differential texture pattern comprising of two or more regions of different textures. For the sake of simplicity in discussion, FIG. 10 illustrates the roller 100 as having two regions of different textures, a textured region 106 and a non-textured, or "smooth," region 108 that does not have any texture engraved. The smooth region 108 surrounded by the textured region 106 forms the word "SECURE" on the surface of the roller 100.

When the textured roller 100, having the differential texture pattern, is heated and pressed against a surface of the document 104, the security code 102 gets formed on the document. In the area of the document where the textured region 106 comes into contact with the toner layer, the gloss is reduced, resulting in the area being deglossed. The remaining area of the document 104 comes in contact only with the smooth region 108 of the roller 100; the gloss in such area remains unmodified and no deglossing results. As a result, the document 104 exhibits a differential gloss pattern that visually forms the security code 102 on the document 104, where the security code 102 is the unmodified gloss area that has come into contact with the smooth region 108 of the roller 100. The differential gloss pattern presents a visualization that can be both observed and physically felt due to the texture imprinted on the document by the roller 100. The pattern serves as a verification mark indicating originality for the document. Any photocopy or fraudulent misrepresentation of the original document can be readily detected when the differential gloss pattern is found absent.

According to the embodiment, various differential gloss patterns may be applied, or imprinted, onto the document to provide the security feature. A particular pattern may include, but is not limited to, a logo, a number, a barcode, a date, an encoded or plain identifying mark, etc. In some embodiments, a particular pattern may be combined with another pattern to be imprinted on the document. For example, a differential gloss pattern that visually creates a logo may be combined with a differential gloss pattern for a bar code on the same document to serve as a security feature.

In some embodiments, the differential gloss pattern may be generated by using a textured roller etched with a micro texture. As used herein, the term "micro texture" refers to a texture generated by having finely spaced texture points etched onto the surface of the roller 100. As used herein, the term "finely spaced" refers to a spacing, between the points, that is not discernible by the ordinary eye and requires extreme magnification to identify. A finely spaced texture is generated at such a small scale that the pattern can be seen, for example, only under extreme magnification. For example, the micro-texture may be etched onto the roller's surface by arranging the points, or "textured bumps," with a spacing of 1/32 of an inch to create a differential texture pattern that spells out the letters "MICRO." When the textured roller, having such differential texture pattern, is imprinted onto a document, the resulting differential gloss pattern would be observable only, for example, under a forensic analysis to detect the MICRO that has been imprinted on the document. A forgery of the document having such micro-texture would be easily detected. The technique using micro texture can be beneficial in many applications, such as counterfeit detection of currency, drug labels, and the like. The benefit of counterfeit protection can advantageously be provided without having to incur additional costs, such as an investment, for example, in special inks; the benefit can be achieved by merely applying texture to an existing, standard, toner-based document.

In some embodiments, the differential gloss patterns may be created using a spot glossing technique. The spot glossing technique includes applying various combinations of temperature (i.e., heat) and pressure to a pair of rollers. The rollers may be the rubber coated roller 80 and the textured roller 84 of FIG. 8. As will be discussed in further details below, the spot glossing technique may be achieved by adjusting the heat applied to textured roller, by adjusting the pressure applied to the pair of rollers (more particularly the rubber coated roller), and/or a combination of the heat and the pressure as selected by a user or an operator of the variable gloss reduction system.

In one embodiment, the spot glossing technique includes reducing the heat in specific regions on the roller in order to remove certain "spots" or areas of gloss (i.e., degloss) of a toner layer formed on a substrate, such as a paper document. Reducing the heat may be accomplished by having a series of gas nozzles linearly spaced down the textured roller 84, where the nozzles are arranged in parallel to the roller's axle. Each gas nozzle has a valve to control an amount of gas that can escape from the nozzle. The gas may be any ordinary pressurized refrigerant, such as $CO_2$ gas. By providing the pressurized refrigerant to the series of gas nozzles, one can dynamically cool individual spots on the roller 84. The cooling can be applied in sequential scan lines to develop a "raster image" of temperature difference on the roller as the roller rotates. In particular, by controlling the valves of the series of nozzles to systematically open and close, a temperature difference is created. This temperature difference along the different regions on the roller gets transferred to the document, and consequently creates a gloss difference on the image formed on the document. The temperature, or heat, may be controlled by a controller. One example of a controller is the PID controller. The PID controller can, for example, control the valves of the nozzles to generate the temperature difference along the different regions on the textured roller.

In one embodiment, the spot glossing technique includes modifying the pressure of a backing roller. The backing roller may be the rubber coated drive roller 80 of FIG. 8. The backing roller may work in conjunction with a textured steel roller, such as the textured roller 84 of FIG. 8, to imprint a differential gloss pattern onto a toner surface of a substrate. According to the embodiment, modifying the pressure may be achieved by using a certain substance to form the body of the backing roller. In one embodiment, a substance of magnetorheological (MR) fluid may be utilized. As used herein, the term "MR fluid" refers to a substance that contains ferrite particles suspended in an oil-like fluid, where the substance has an ability to change its stiffness in the presence of a magnetic field. In particular, when the magnetic field is present, the ferrite particles line up, resulting in the substance being difficult to compress. In the absence of the magnetic field, the substance becomes easily compressible.

In one embodiment, the backing roller may be wrapped in a container containing the substance discussed above (i.e., the MR fluid). The container may be, for example, a tube or a bladder that is capable of being flexible to surround the backing roller. In some embodiments, the tube or the bladder may be placed underneath a rubber coating that forms the surface of the backing roller. In other embodiments, the tube or bladder may be placed over on top of the rubber coating. A series of electromagnets may then be placed linear to the axle of the backing roller (e.g., roller 80), similar to the arrangement of the gas nozzles with respect to the textured roller discussed above (e.g., textured roller 84). A current may be applied to some of the electromagnets placed within the backing roller to create a change in pressure between the backing roller and the textured roller; that is, the current causes the magnetic field of the electromagnets within the backing roller to change, resulting in certain areas of the surface of the backing rubber to be compressible. The current may be controlled by a controller, such as the PID controller. When a substrate, such as the printed document, is pressed between the backing roller and the textured roller, the pressure resulting from the two rollers rolling together is reduced in certain regions of the substrate. Such reduced pressure in some regions and not others generates an "image" of pressure differences. Such pressure image generates an image of differential gloss, i.e., a differential gloss pattern, on the substrate when the document is pressed and rolled through between the rollers.

In some embodiments, the differential gloss patterns may be detected using various software and/or hardware systems that are configured to read and/or verify the security feature as part of a security enforcement system. One such system may include, for example, a light source component, a still image or video pixel sensor component, and an image processor component, where the components are utilized to reveal a differential gloss not easily discernible by the human eye. The system may be implemented, for example, as a mobile application on a smartphone (e.g., Android® based phone, an Apple® phone, etc.).

Computer Implementation

Figure 11:
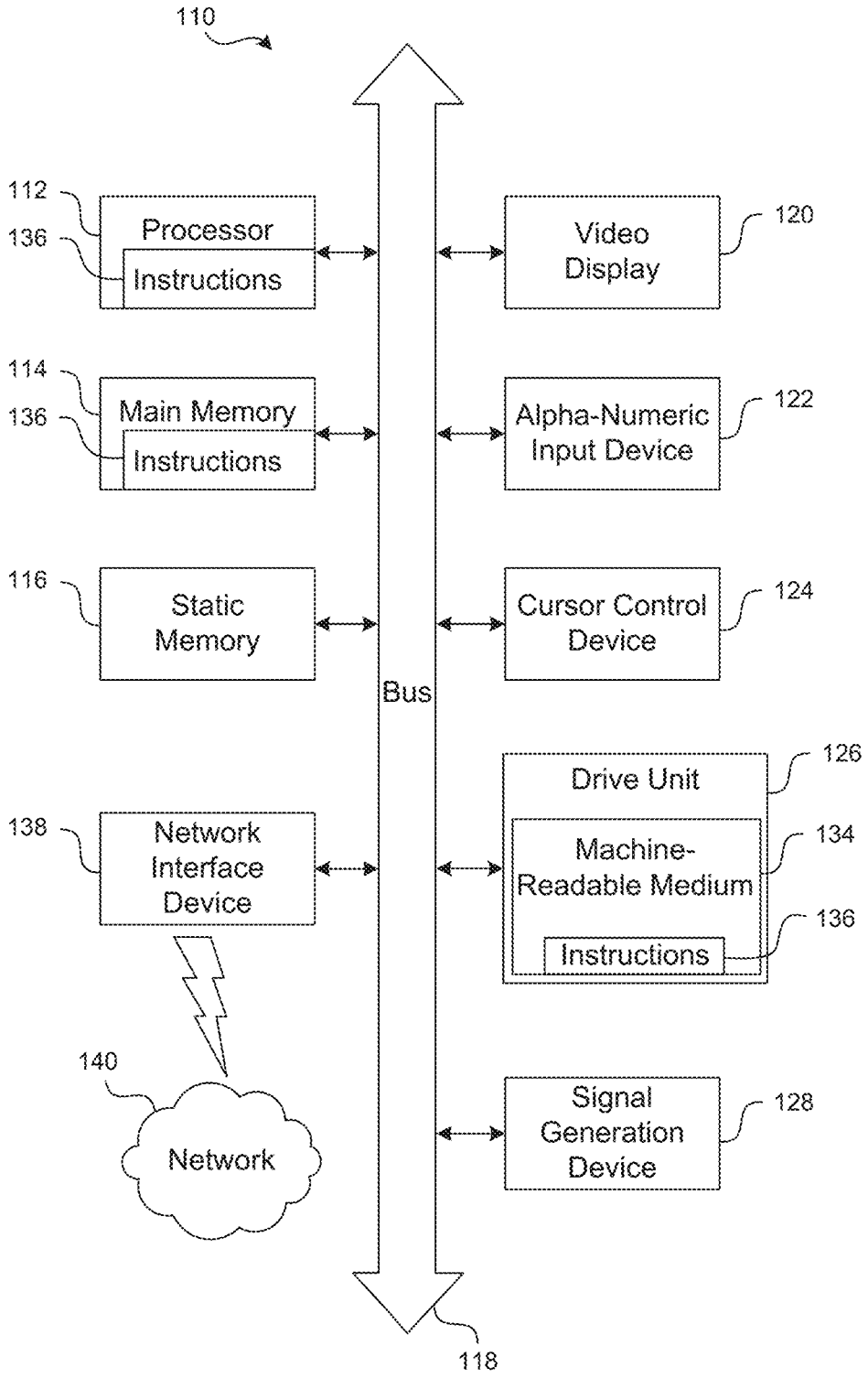
FIG. 11 is a block schematic diagram that depicts a machine in the exemplary form of a computer system within which a set of instructions for causing the machine to perform any of the herein disclosed methodologies may be executed.

FIG. 11 is a block schematic diagram that depicts a machine in the exemplary form of a computer system 110 within which a set of instructions for causing the machine to perform any of the herein disclosed methodologies may be executed. In alternative embodiments, the machine may comprise or include a network router, a network switch, a network bridge, personal digital assistant (PDA), a cellular telephone, a Web appliance or any machine capable of executing or transmitting a sequence of instructions that specify actions to be taken.

The computer system 110 includes a processor 112, a main memory 114 and a static memory 116, which communicate with each other via a bus 118. The computer system 110 may further include a display unit 120, for example, a liquid crystal display (LCD) or a cathode ray tube (CRT). The computer system 110 also includes an alphanumeric input device 122, for example, a keyboard; a cursor control device 124, for example, a mouse; a disk drive unit 126, a signal generation device 128, for example, a speaker, and a network interface device 138.

The disk drive unit 126 includes a machine-readable medium 134 on which is stored a set of executable instructions, i.e., software, 136 embodying any one, or all, of the methodologies described herein below. The software 136 is also shown to reside, completely or at least partially, within the main memory 114 and/or within the processor 112. The software 136 may further be transmitted or received over a network 140 by means of a network interface device 138.

In contrast to the system 110 discussed above, a different embodiment uses logic circuitry instead of computer-executed instructions to implement processing entities. Depending upon the particular requirements of the application in the areas of speed, expense, tooling costs, and the like, this logic may be implemented by constructing an application-specific integrated circuit (ASIC) having thousands of tiny integrated transistors. Such an ASIC may be implemented with CMOS (complementary metal oxide semiconductor), TTL (transistor-transistor logic), VLSI (very large systems integration), or another suitable construction. Other alternatives include a digital signal processing chip (DSP), discrete circuitry (such as resistors, capacitors, diodes, inductors, and transistors), field programmable gate array (FPGA), programmable logic array (PLA), programmable logic device (PLD), and the like.

It is to be understood that embodiments may be used as or to support software programs or software modules executed upon some form of processing core (such as the CPU of a computer) or otherwise implemented or realized upon or within a machine or computer readable medium. A machine-readable medium includes any mechanism for storing or transmitting information in a form readable by a machine, e.g., a computer. For example, a machine readable medium includes read-only memory (ROM); random access memory (RAM); magnetic disk storage media; optical storage media; flash memory devices; electrical, optical, acoustical or other form of propagated signals, for example, carrier waves, infrared signals, digital signals, etc.; or any other type of media suitable for storing or transmitting information.

Although the invention is described herein with reference to the preferred embodiment, one skilled in the art will readily appreciate that other applications may be substituted for those set forth herein without departing from the spirit and scope of the present invention.

For example, embodiments of the invention provide for selective de-glossing of portions of prints. Thus, various creative effects can be achieved, where portions of a print, such as text, are deglossed to varying degrees as desired, while other portions of the print remain glossy. These effects can be achieved at any desired level of granularity, such as page by page in a multipage document, page element by page element within a page, or within a particular page element, for example where a portion of an image is to be highlighted or deemphasized based upon amount of gloss. Further, those skilled in the art will appreciate that the various parameters taught herein for effecting control of gloss can be adjusted as desired alone or in combination. Thus, embodiments of the invention include the use of pressure, heat, chemicals, and combinations thereof to control gloss within a print. The use of heat and pressure is discussed above. With regard to chemicals, any of a number of known chemicals, e.g. solvents and the like, can be used to soften toner applied to the substrate to allow the roller to degloss the image printed on the substrate. Such chemicals can be applied directly to the roller by a spray mechanism or from within the roller via one or more apertures formed through the surface thereof; or a print head or the like may be used to selectively spray a solvent or other chemical on an image or portion thereof formed on a substrate.

Accordingly, the invention should only be limited by the Claims included below.

What is claimed:

1. A method for generating an originality mark on a document having a smooth toner layer that forms a printed image on the document, comprising:

adjusting a compressibility of a compressible surface of a backing roller;

adjusting a temperature of a differential texture surface of a textured roller; the differential texture surface comprising a textured region and a smooth region, and pressing and rolling the document between the backing roller and the textured roller, wherein deglossing occurs in an area of the document where the textured region comes into contact with the toner layer and wherein no deglossing occurs in a remaining area of the document which comes in contact only with the smooth region, to imprint a differential gloss pattern onto the smooth toner layer, wherein the compressibility and the temperature of the respective rollers create a desired differential gloss pattern to generate the originality mark on the printed image of the document.

2. The method of claim 1, wherein the backing roller includes a plurality of electromagnets coupled to the compressible surface, wherein the compressible surface includes a compressible material that compresses in response to a change in a magnetic field associated with the plurality of electromagnets.

3. The method of claim 2, wherein adjusting the compressibility of the compressible surface comprises:

applying an amount of current to the plurality of electromagnets to generate the change in the magnetic field.

4. The method of claim 1, wherein the textured roller includes a plurality of gas nozzles arranged alongside the differential texture surface, wherein each of the plurality of gas nozzles is configured to release a cooling gas to generate a temperature difference alongside the differential texture surface.

5. The method of claim 4, wherein adjusting the temperature of the differential texture surface comprises:

controlling the plurality of gas nozzles to release the cooling gas at certain regions alongside the differential texture surface of the textured roller, the certain regions with the cooling gas creating the temperature difference alongside the differential texture surface.

* * * * *